US009899764B1

(12) United States Patent
Lin

(10) Patent No.: US 9,899,764 B1
(45) Date of Patent: Feb. 20, 2018

(54) CABLE CONNECTOR

(71) Applicant: Yung-Ping Lin, Zhubei (TW)

(72) Inventor: Yung-Ping Lin, Zhubei (TW)

( * ) Notice: Subject to any disclaimer, the term of this patent is extended or adjusted under 35 U.S.C. 154(b) by 0 days.

(21) Appl. No.: 15/461,888

(22) Filed: Mar. 17, 2017

(51) Int. Cl.

| | |
|---|---|
| ***H01R 9/05*** | (2006.01) |
| ***H01R 13/52*** | (2006.01) |
| ***H01R 24/38*** | (2011.01) |
| ***H01R 13/10*** | (2006.01) |
| *H01R 103/00* | (2006.01) |

(52) U.S. Cl.
CPC ..... *H01R 13/5202* (2013.01); *H01R 13/10* (2013.01); *H01R 24/38* (2013.01); *H01R 2103/00* (2013.01)

(58) Field of Classification Search
CPC ..... H01R 9/05; H01R 24/38
See application file for complete search history.

(56) References Cited

U.S. PATENT DOCUMENTS 3,847,463 A * 11/1974 Hayward ..... C07C 17/208 439/28
4,491,685 A * 1/1985 Drew ..... H01R 9/05 174/75 C
4,854,893 A * 8/1989 Morris ..... H01R 9/0521 439/578
5,498,175 A * 3/1996 Yeh ..... H01R 24/542 439/276
2007/0155231 A1* 7/2007 Tang ..... H01R 24/547 439/578
2015/0011120 A1* 1/2015 Goebel ..... H01R 24/46 439/578

* cited by examiner

*Primary Examiner* — Tho D Ta
(74) *Attorney, Agent, or Firm* — Rosenberg, Klein & Lee

(57) ABSTRACT

The invention is a connector, which has an insulating housing, a female terminal, a guide needle and a waterproof structure. The insulating housing had a housing, a first and a second insulating sleeves. The first and the second insulating sleeves, and the waterproof structure are disposed in the housing. The first insulating sleeve is mounted with the second insulating sleeve in order to form a compartment space. The first insulating sleeve includes at least three fixing portions. The female terminal has a clamping portion, a securing portion and a guiding needle clamping portion. The clamping portion has at least three tighten portion and at least three slits, which forms at least three blades. The securing portion includes at least three convex portions, which disposed corresponding to the fixing portions. The guide needle buckles with the guiding needle clamping portion. The waterproof structure disposed against the second insulating sleeve.

10 Claims, 10 Drawing Sheets

CABLE CONNECTOR

FIELD OF THE INVENTION

The present invention relates to a connector. More precisely, the present invention is related to a connector structure that could improve the holding and the electrical properties between the female and the male terminal.

BACKGROUND

Via connecting male terminal with a connector, the television signal could be transmitted. Previous connector includes an electrical insulating housing, a female terminal and guiding needle.

The male terminal would penetrate through the electrical insulating housing and contact with the female terminal directly. The electric signal would be transmit from the male terminal to the female terminal.

There are some problems in nowadays connectors, such as the fatigue resistance and the clamping force of the female terminal is relatively low; the female terminal are loosely connect with the male terminal; and the waterproof of the connector.

Therefore how to overcome the above problem in the field is a need.

SUMMARY

It is one object of the present invention to provide a connector that could improve the holding and the electrical properties between the female and the male connector.

Another objection of the present invention is to provide a connector that can improve compatibility better than those of a known connector.

Yet another objection of the present invention is to provide a connector which can increase the fatigue resistance.

Other objection of the present invention is to provide a connector which can increase the clamping force.

Present invention discloses a connector, which comprises an electrical insulating housing, a female terminal, a guide needle and a waterproof structure.

The insulating housing comprises a housing, a first insulating sleeve and a second insulating sleeve, and the first and the second insulating sleeves disposing in the housing. The first insulating sleeve buckles with the second insulating sleeve and form a compartment space. The first insulating sleeve has at least three fixing portions. The female terminal is disposed in the compartment space; the female terminal is a hollow cylinder. The female terminal comprises a clamping portion, a securing portion and a guiding needle clamping portion.

The clamping portion comprises at least three tighten portion and at least three slits. The at least three slits form at least three blades, and the surface of these blade are forming into a continuous curve. The securing portion comprises at least three convex portions, the convex portions is disposed corresponding to at least three fixing portions of the first insulating sleeve.

The guide needle buckles with the guiding needle clamping portion of the female terminal. The waterproof structure disposes at the housing and disposing against the second insulating sleeve.

According to one embodiment of the present invention, wherein the housing is a hollow cylinder, and the housing comprises multiple ribs, disposing near the first insulating sleeve.

According to one embodiment of the present invention, wherein the ribs are equally disposed at one end of the housing.

According to one embodiment of the present invention, wherein the first insulating sleeve is made of flexible material and mounts with the ribs.

According to one embodiment of the present invention, wherein the external diameter of the first insulating sleeve is smaller or equal to the interior diameter of the second insulating sleeve. Furthermore, the first insulating sleeve is partially mounted inside the second insulating sleeve.

According to one embodiment of the present invention, wherein the at least three convex portions is made by impact molding.

According to one embodiment of the present invention, the waterproof structure has a waterproof washer and an insulating material. The waterproof washer is disposed between the insulating material and the second insulating sleeve.

According to one embodiment of the present invention, the waterproof washer is circular column and the waterproof washer is made of flexible material.

According to one embodiment of the present invention, the waterproof washer further comprises at least one needle-guiding groove.

According to one embodiment of the present invention, the waterproof washer further comprises two needle-guiding grooves and the two needle-guiding grooves disposed on the each side of the waterproof washer, and the needle-guiding grooves are aligned to each other.

To conclude, in the present invention, the connector has blade that formed into a continuous curve (curve shape) and the female terminal with clamping portion could achieve the objection of improving the compatibility and the fatigue resistance. The multiple blades could increase the contacting area and the number of contact area between the male terminal and the female terminal. The clamping force and the electric performance would be increased. Via the convex portions and the fixing portions the female terminal could be fixed with the first insulating sleeve and prevent the female terminal drop off while using. Furthermore, the other advantages of the present invention is via buckling the first insulating sleeve directly with the female terminal could also aligned the through hole of the first insulating sleeve with the through hole of the female terminal therefore maintained and improve the concentricity of the two and decrease the tolerance of the connector.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Figure 1:
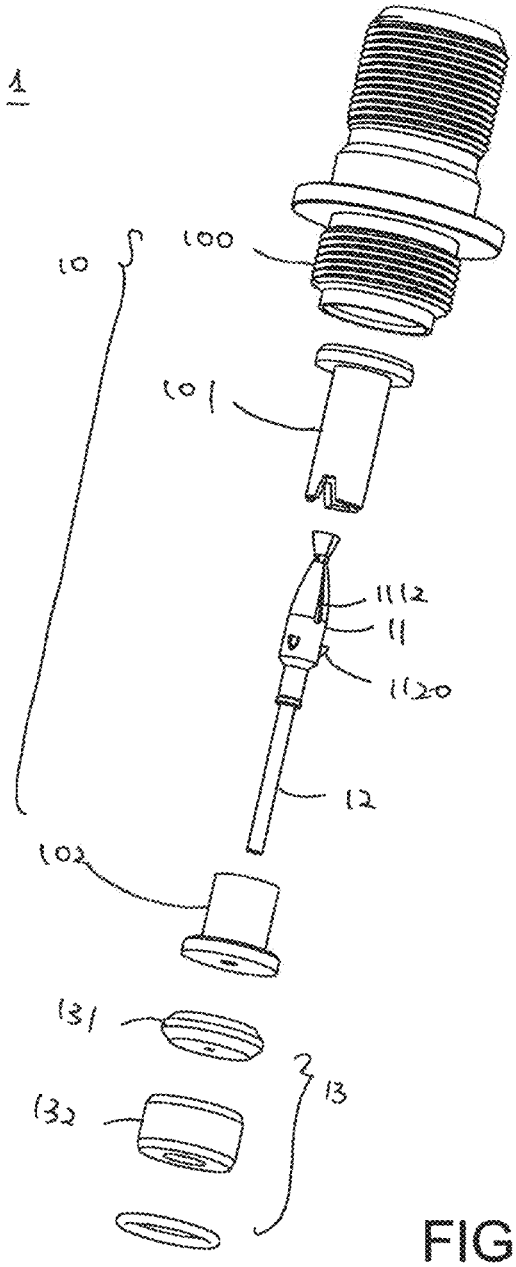
FIG. 1 is an exploded perspective view of the connector of an embodiment of the present invention.
Figure 2:
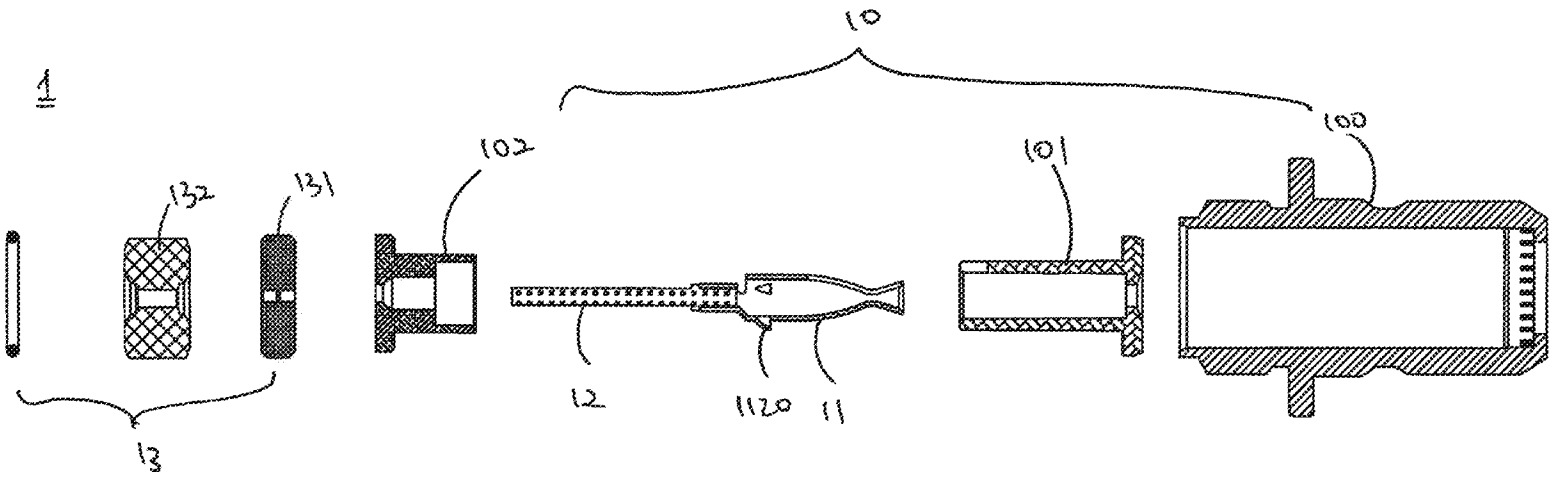
FIG. 2 is a side view of the connector utilized in the embodiment of FIG. 1, showing in section view.

First, please refer to FIG. 1 and FIG. 2. FIG. 1 is an exploded perspective view of the connector of an embodiment of the present invention. FIG. 2 is a side view of the connector utilized in the embodiment of FIG. 1, showing in section view;

Present embodiment discloses a connector 1, for connecting with a male terminal for transmitting signal. More precisely for transmitting television signal. In the present embodiment, the connector 1 comprises an electrical insulating housing 10, a female terminal 11, a guide needle 12 and a waterproof structure 13. In the present embodiment, the size or the type of the male terminal is not limited.

The insulating housing 10 comprises a housing 100, a first insulating sleeve 101 and a second insulating sleeve 102. The housing 100 in the present embodiment is a hollow cylinder. The first insulating sleeve 101 and the second insulating sleeve 102 are made of insulating material such as silicon. Furthermore, the first insulating sleeve 101 could be made of flexible material.

The first and the second insulating sleeves 101, 102 are disposed in the housing 100. The first insulating sleeve 101 would buckle with the second insulating sleeve 102 in order to form a compartment space.

The external diameter of the first insulating sleeve 101 is smaller or equal to the interior diameter of the second insulating sleeve 102. Furthermore, the first insulating sleeve 101 is partially mounted inside the second insulating sleeve 102.

Figure 3:
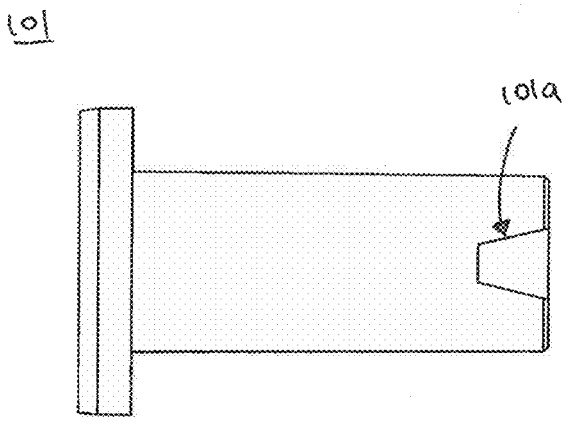
FIG. 3 is the side view of the first sleeve of the connector.
Figure 4:
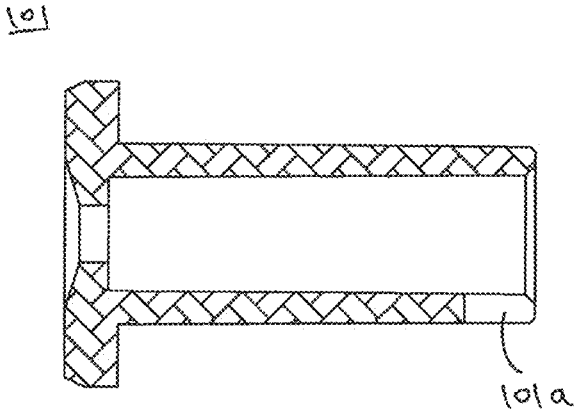
FIG. 4 is the cross-section view of FIG. 3.

Then, please refer to FIG. 3 and FIG. 4. FIG. 3 is the side view of the first sleeve of the connector, FIG. 4 is the cross-section view of FIG. 3;

The first insulating sleeve 101 could be made of flexible material such as silicon but not limited to. In this embodiment, the first insulating sleeve 101 has at least three fixing portions 101*a*. It should be noted that, the number of the fixing portions are not limited to three, in some embodiments; the fixing portions could be four or five if needed. In previous embodiment, the fixing portions 101*a* is a U shape groove, and the fixing portions 101*a* could buckle with the female terminal 11.

Figure 5:
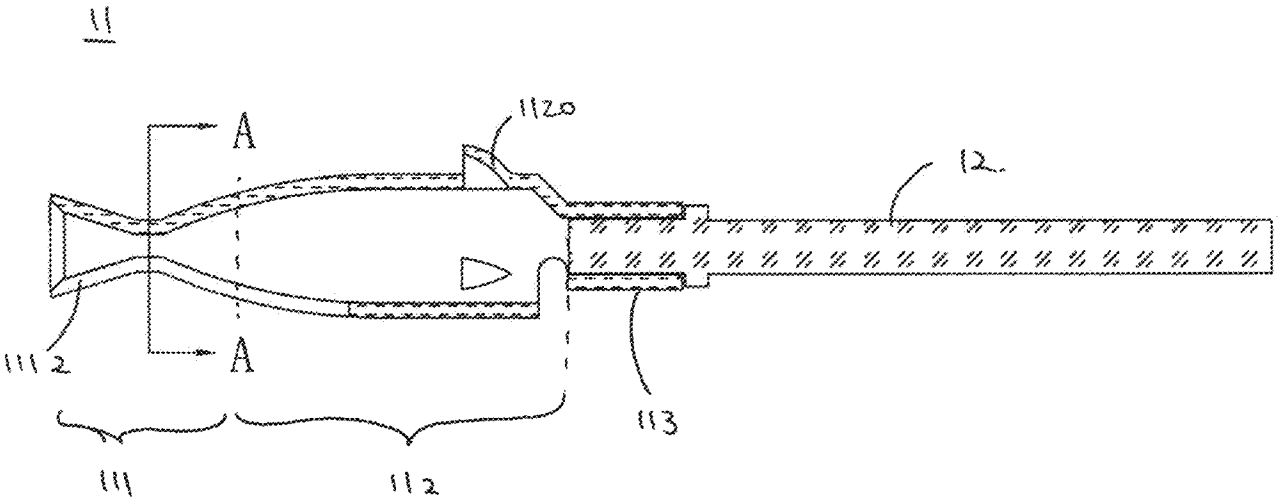
FIG. 5 is a side view of the female terminal and the guide needle utilized in the embodiment of FIG. 1, showing in section view.
Figure 6:
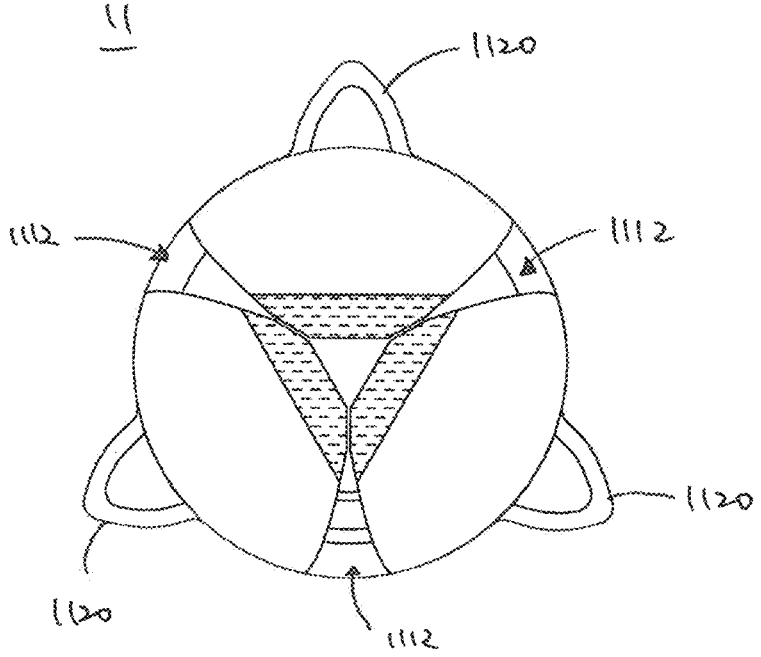
FIG. 6 is a cross-section view of FIG. 5 along AA secant line.

Please refer to FIG. 5 and FIG. 6 together. FIG. 5 is a side view of the female terminal and the guide needle utilized in the embodiment of FIG. 1, showing in section view. FIG. 6 is a cross-section view of FIG. 5 along AA secant line;

In this embodiment, the female terminal 11 is disposed in the compartment space, which formed by the first insulating sleeve 101 and the second insulating sleeve 102. The female terminal 11 of the present invention is a hollow cylinder.

The female terminal 11 comprises a clamping portion 111, a securing portion 112 and a guiding needle clamping portion 113. Clamping portion 111 could clamp the male terminal (not shown in FIG. 5 and FIG. 6), and via the clamping portion 111, the female terminal 11 is electrically connect with the male terminal. The securing portion 112 is used for buckling with the guide needle 12. In other way, the guide needle 12 could be buckled with the female terminal 11 via the securing portion 112.

The securing portion 112 comprises at least three convex portions 1120. Each of the convex portions 1120 is disposed corresponding to at least three fixing portions 101*a* of the first insulating sleeve 101. These convex portions 1120 are made by impact molding.

The clamping portion 111 comprises three tighten portions 1110 and three slits 1112. In this embodiments, the number of the tighten portions and the slits are not limited. The clamping portion 111 extends along the first insulating sleeve 101 and formed into a gradually enlarged guiding entrance. The three slits 1112 of the clamping portion 111 divide the clamping portion 111 into at least three blades. The surfaces of these blades are forming into a continuous curve. As shown in the figures, these blades are curve double-sided surface, which is curved in horizontal and vertical direction. While assembling the female terminal 11 with the first insulating sleeve 101, the male terminal could be guided through the clamping portion 111, and the blades would ensure the male terminal connecting with the female terminal 11.

In addition, these blades are designed in curve shape, and the outer diameter of the blades decrease along the axial direction in order to narrow down the width of the slits. That is the width of the slit is gradually decreased along the axial direction, too. The objection and the advantages of the present invention is: the female terminal is enable to compatible with male terminal with different sizes; improve the fatigue resistance of the blade, increase the contact area between the blade and the male terminal in order to improve the clamping force of the female terminal. The embodiment of the present invention are compatible with smallest the male terminal in the market, and are capable to provide enough clamping force between the female terminal and the male terminal.

Referring to FIG. 6. FIG. 6 is a cross-section view of FIG. 5 along AA secant line. It would be obvious for one in art realize that the contact area is larger than other connector in the market. For those in the market, the female terminal and the male terminal only connect via two points or comprising type to contact. The connector in the market withstand a force of 75 grams in testing, but the female terminal 11 in present invention could withstand a force of 100 grams during the test. The cross-section of these blades are formed into a non-circle opening (may be a polygon-liked shape.) When the female terminal plugin, the blades would contact with the male terminal and formed multiple contact area or contact surface. Thus, the male terminal would be clamped by the blades. It should be noted that, since the blades is adjustable, different from the connector in the market, the connector of present invention is capable for fitting different size male terminal. With this arrangement the usage of the connector would be more flexible.

Figure 7:
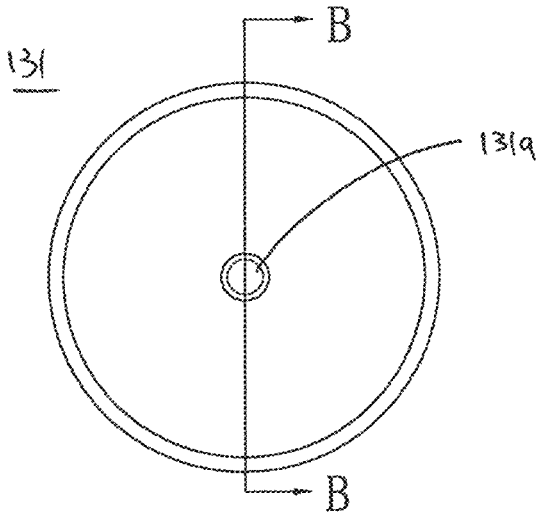
FIG. 7 is a top view of the waterproof structure of the connector of the present invention.
Figure 8:
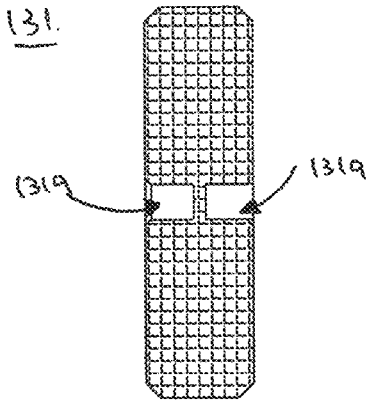
FIG. 8 is a cross-section view of FIG. 7 along BB secant line.

Please refer to FIG. 7 and FIG. 8 together. FIG. 7 is a top view of the waterproof structure of the connector of the present invention. FIG. 8 is a cross-section view of FIG. 7 along BB secant line. In a preferred embodiment of the present invention, the connector 1 comprises a waterproof structure 13, and the waterproof structure 13 is disposed inside the housing 100 of the electrical insulating housing 10. The waterproof structure 13 is attached to the second insulating sleeve 102. The waterproof structure 13 disposes at the housing 100 and disposing against the second insulating sleeve 102. The waterproof structure 13 further includes a waterproof washer 131 and an insulating material 132. The waterproof washer 131 is disposed between the insulating material 132 and the second insulating sleeve 102.

In the present embodiment, the waterproof washer 131 is circular column and the waterproof washer is made of flexible material. Said waterproof washer 131 is disposed corresponding to the electrical insulating housing 10 in order to block the water or vapor entering the connector 1. The waterproof washer 131 will be disposed at the distance side (refer to the guide needle 12) of the electrical insulating housing 10. The electrical insulating housing 10 could ensure the guide needle 12 in a dry condition.

In addition, the waterproof washer 131 chamfered at the edge of the circular column (FIG. 8). The chamfered edge could let the waterproof washer 131 mounts into the second insulating sleeve 102 more easily, and decrease the leakage of the connector. While assembling the waterproof washer 131, the flexible and expanding property would let waterproof washer 131 squeezes and fit into the second insulating sleeve 102. The waterproof washer 131 could prevent any gap or space between the waterproof washer 131 and the second insulating sleeve 102 preventing water or vapor leak into the second insulating sleeve 102.

Please refer to FIG. 8 again; the waterproof washer 131 further comprises at least one needle-guiding groove 131*a*. In the present embodiment, waterproof washer 131 has two the needle-guiding grooves 131*a*, that disposed in the either side of the waterproof washer 131. The two needle-guiding grooves 131*a* disposed on the each side of the waterproof washer 131, and the needle-guiding grooves 131*a* are aligned to each other.

It should be noted that, each of the needle-guiding grooves 131*a* disposed corresponding to each other, but none of the needle-guiding grooves 131*a* is a through hole. The guide needle 12 would be guide through one of the needle-guiding grooves 131*a* and penetrate the waterproof washer 131. The advantage of penetrating the waterproof washer 131 with the guide needle 12 is that the gap or space the guide needle 12 and the waterproof washer 131 would be eliminated. The waterproof could be improved. Via this arrangement, while manufacturing the waterproof washer 131, the needle-guiding grooves 131*a* would not need to be very precisely as the through hole of the washer in the art. In the present field, the through hole of the washer should be aligned accurately to avoid mechanical tolerances adding up. Furthermore, by penetrating the waterproof washer 131 via the guide needle 12 would also increase the tightness between the two and improve the waterproof of the connector.

Figure 9:
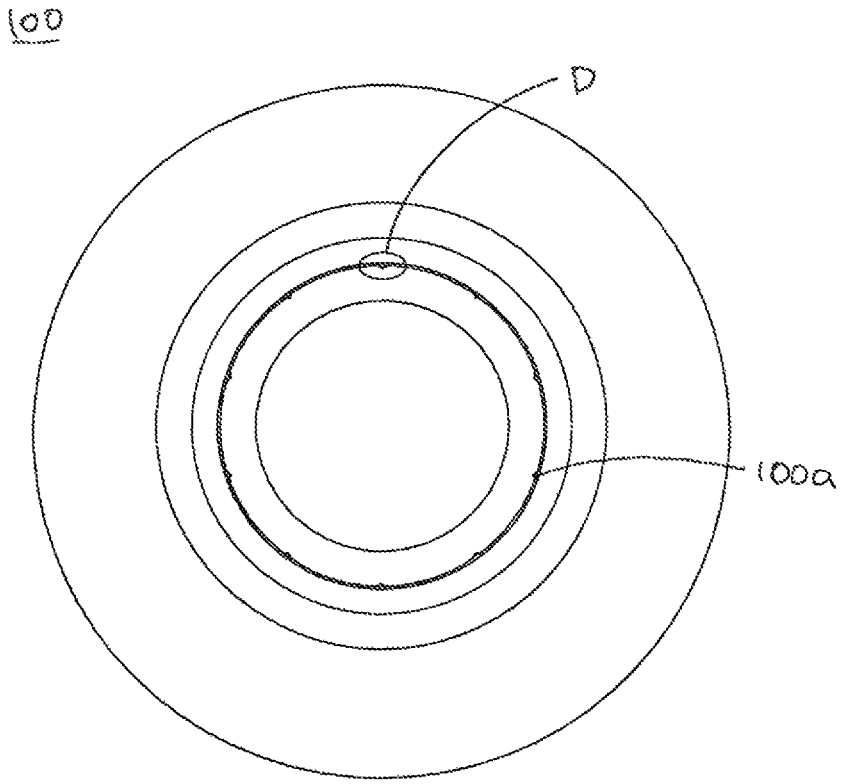
FIG. 9 is a perspective view of housing of the present invention.
Figure 10:
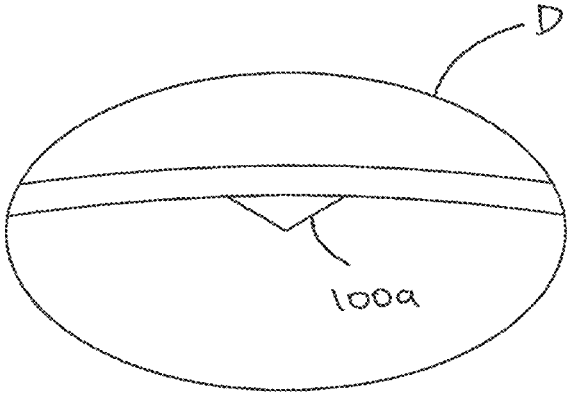
FIG. 10 is an enlarge view of FIG. 9 of region D.

Please refer to FIG. 9 and FIG. 10. FIG. 9 is a perspective view of housing of the present invention. FIG. 10 is an enlarge view of FIG. 9 of region D.

As mentioned in previous paragraphs, the insulating housing 10 comprises a housing 100, and the housing 100 comprises multiple ribs 100*a* that disposing near the first insulating sleeve 101. In the preferred embodiment, the housing 100 has ten ribs 100*a*, but the numbers of the ribs are not limited to ten. The ribs 100*a* are triangular pyramid, in some embodiments the ribs could also be formed as square based pyramid or jagged column. The first insulating sleeve 101 is made of flexible material and mounts with the ribs 100*a*, therefore when assembling the rib 100*a* could buckle or bit into the first insulating sleeve 101. This may ensure the first insulating sleeve 101 would not slide or move after assemble. When the first insulating sleeve 101 is mounted with the housing 100, the hole of the housing 100 could aligned with the hole of the first insulating sleeve 101, ensure the concentricity between the housing 100 and the first insulating sleeve 101, and the overall mechanic tolerance will decrease. The connector 1 could provide a better accurateness and stability.

In the present embodiment, the ribs 100*a* are equally disposed at one end of the housing 100, but the disposing method is not limited to.

Figure 11:
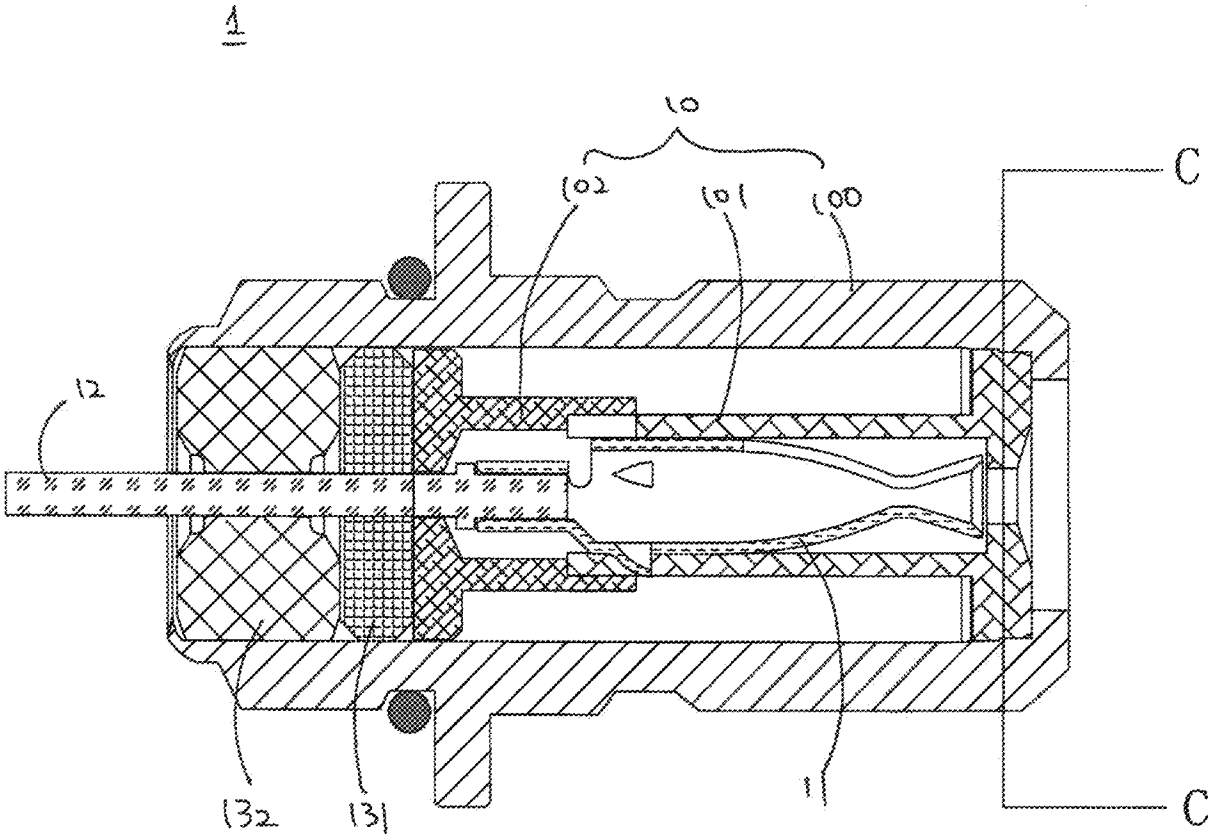
FIG. 11 is the cross-section view of the connector of present invention.
Figure 12:
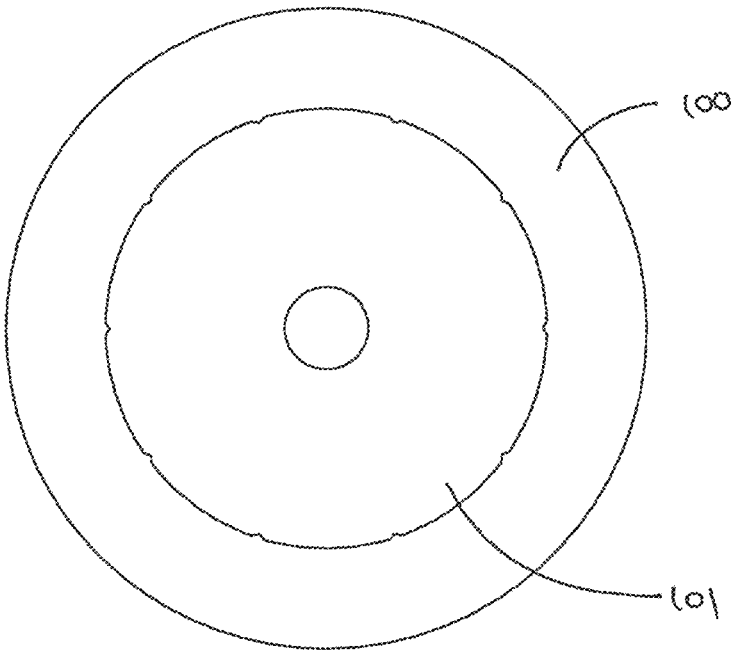
FIG. 12 is a cross-section view of FIG. 11 along CC secant line.

Last but not least, please refer to FIG. 1 and FIG. 12. FIG. 11 is the cross-section view of the connector of present invention. FIG. 12 is a cross-section view of FIG. 11 along CC secant line.

While assembling the connector 1, first the guide needle 12 would penetrate through the second insulating sleeve 102. Then, buckle the fixing portions 101*a* of the first insulating sleeve 101 with three the convex portions 1120 of the female terminal 11. Therefore, the female terminal 11 would be mounted with the first insulating sleeve 101. The first insulating sleeve 101 will be fixed with the second insulating sleeve 102. The guide needle 12 would be guided through the needle-guiding grooves 131*a* and penetrate through the waterproof washer 131. Then the waterproof washer 131 would be disposed on the guide needle 12. Last the end of the housing 100 near the waterproof washer 131 snap into a riveting shape, and the assembling of the connector 1 would be done.

Via the design and the combination of the convex portions 1120, the fixing portions 101*a*, the tighten portions 1110 and the slits 1112, the female terminal 11 would be ensure inside the insulating housing 10. The female terminal 11 would not spin or rotate relative to the insulating housing 10.

Moreover, when the male terminal penetrates the first insulating sleeve 101 and the female terminal 11, the multiple blades of the female terminal 11 would clamp the male terminal and directly connect with the male terminal. The electrical signal would be transmitted to the guide needle 12 via female terminal 11. The transmission would cut off if the male terminal pulls out.

To conclude, in the present invention, the connector has blade that formed into a continuous curve (curve shape) and female terminal with clamping portion could achieve the objection of improving the compatibility and the fatigue resistance. The multiple blades could increase the contacting area and the number of contact area between the male terminal and the female terminal. The clamping force and the electric performance would be increased. Via the convex portions and the fixing portions the female terminal could be fixed with the first insulating sleeve and prevent the female terminal drop off while using.

The above disclosure is only the preferred embodiment of the present invention, and not used for limiting the scope of the present invention. All equivalent variations and modifications on the basis of shapes, structures, features and spirits described in claims of the present invention should be included in the claims of the present invention.

While the invention has been described with referencing to the preferred embodiment thereof, it is to be understood that modifications or variations may be easily made without departing from the spirit of this invention, which is defined by the appended claims.

What is claimed is:

1. A connector, comprising:

a housing, a first insulating sleeve and a second insulating sleeve, and the first and the second insulating sleeves disposing in the housing, wherein the first insulating sleeve and the second insulating sleeve are two different components, wherein an external diameter of the first insulating sleeve is smaller or equal to an interior diameter of the second insulating sleeve, and the first insulating sleeve is partially mounted inside the second insulating sleeve, and the first insulating sleeve buckle with the second insulating sleeve forming a compartment space, the first insulating sleeve comprising at least three grooves;

a female terminal, disposing in the compartment space, the female terminal is a hollow cylinder, the female terminal comprising a clamping portion, a securing portion and a guiding needle clamping portion;

wherein, the clamping portion comprises a tighten portion and at least three slits, the at least three slits forming at least three blades, and a surface of these blade are forming into a continuous curve, wherein the securing portion comprises at least three convex portions, the convex portions disposing corresponding to the at least three grooves of the first insulating sleeve, wherein the convex portions are restricted within the grooves by the first insulating sleeve and the second insulating sleeve that are connected each other;

a guide needle, buckling with the guiding needle clamping portion of the female terminal; and a waterproof structure, disposing at the housing and disposing against the second insulating sleeve.

2. The connector of claim 1, wherein the housing is a hollow cylinder, and the housing comprises multiple ribs, disposing near the first insulating sleeve.

3. The connector of claim 2, wherein the first insulating sleeve is made of flexible material and mounts with the ribs.

4. The connector of claim 1, wherein the at least three convex portions is made by impact molding.

5. The connector of claim 2, wherein the ribs are equally disposed at one end of the housing.

6. The connector of claim 5, wherein the first insulating sleeve is made of flexible material and mounts with the ribs.

7. The connector of claim 1, wherein the waterproof structure comprising a waterproof washer and an insulating material, and the waterproof washer is disposed between the insulating material and the second insulating sleeve.

8. The connector of claim 7, wherein the waterproof washer is circular column and the waterproof washer is made of flexible material.

9. The connector of claim 8, wherein the waterproof washer further comprises at least one needle-guiding groove.

10. The connector of claim 9, wherein the waterproof washer further comprises two needle-guiding grooves and the two needle-guiding grooves disposed on the each side of the waterproof washer, and the needle-guiding grooves are aligned to each other.

* * * * *